US008329029B2

(12) United States Patent
Greeley

(10) Patent No.: US 8,329,029 B2
(45) Date of Patent: Dec. 11, 2012

(54) SELECTIVE DESULFURIZATION OF NAPHTHA USING REACTION INHIBITORS

(75) Inventor: John P. Greeley, Gaithersburg, MD (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 324 days.

(21) Appl. No.: 12/878,351

(22) Filed: Sep. 9, 2010

(65) Prior Publication Data

US 2011/0180457 A1 Jul. 28, 2011

Related U.S. Application Data

(60) Provisional application No. 61/276,351, filed on Sep. 11, 2009.

(51) Int. Cl.
*C10G 45/02* (2006.01)
*C10G 45/00* (2006.01)
*C10G 35/00* (2006.01)

(52) U.S. Cl. ..... 208/209; 208/216 R; 208/217; 208/133

(58) Field of Classification Search ..... 208/209, 208/216 R, 217
See application file for complete search history.

(56) References Cited

U.S. PATENT DOCUMENTS 2,913,405 A 11/1959 Shalit
3,816,296 A 6/1974 Yoshida et al.
6,231,754 B1 5/2001 Brignac et al.
7,361,265 B2 4/2008 de Almeida et al.
2003/0217952 A1 11/2003 Brignac et al.
2003/0220186 A1 11/2003 Brignac et al.
2003/0221994 A1 12/2003 Ellis et al.
2004/0055936 A1 3/2004 Diehl et al.
2009/0145807 A1 6/2009 Choi et al.
2009/0223866 A1 9/2009 Bhan

FOREIGN PATENT DOCUMENTS

GB 1 228 985 4/1971
WO 00/12653 3/2000

OTHER PUBLICATIONS

T.A. Lalain, G.B. Brignac, M.G. Lee, "The Effect of CO Inhibition on the Activity of RT-225 and KF-742", 2002EMPR113, Jun. 24, 2002.
M. Egorova, R. Prins, "Mutual influence of the HDS of dibenzothiophene and HDN of 2-methylpyridine", Journal of Catalysis, vol. 221,1, pp. 11-19, Jan. 1, 2004.
Xiang Chun-e, Chai Yong-ming, Liu Yun-qi, Liu Chen-guang, "Mutual influences of hydrodesulfurization of dibenzothiophene and hydrodenitrogenation of indole over NiMoS/Y-A12O3 catalyst", Journal of Fuel Chemistry and Technology, vol. 36, Issue 6, pp. 684-690, Dec. 2008.

*Primary Examiner* — Walter D Griffin
*Assistant Examiner* — Derek Mueller
(74) *Attorney, Agent, or Firm* — Bruce M. Bordelon

(57) ABSTRACT

A reaction inhibitor can be used to reduce catalyst activity at the beginning of a naphtha selective hydrodesulfurization process. The use of the reaction inhibitor can allow greater flexibility in selecting the reaction conditions to accommodate both the start and end of the hydrodesulfurization process. The reaction inhibitor can be removed during the hydrodesulfurization process, possibly in conjunction with modification of the reaction temperature, in order to maintain a substantially constant amount of sulfur in the naphtha product.

20 Claims, 3 Drawing Sheets

SELECTIVE DESULFURIZATION OF NAPHTHA USING REACTION INHIBITORS

This application claims the benefit of U.S. Application 61/276,351, filed Sep. 11, 2009.

FIELD OF THE INVENTION

This invention provides a process for the manufacture of a naphtha boiling range product with improved properties.

BACKGROUND OF THE INVENTION

One conventional technique for processing of cracked naphthas involves performing a selective hydrodesulfurization of the cracked naphtha. A selective hydrodesulfurization refers to a process where sulfur is removed from the naphtha while minimizing the amount of olefin saturation that occurs in the reaction. Avoiding olefin saturation is valuable, as it leads to a higher octane naphtha product. Retaining a higher octane value allows a selectively hydrodesulfurized feed to be used as a naphtha fuel stock without having to use a reforming step.

The catalysts used for a selective hydrodesulfurization process typically include a combination of a Group VI metal and a Group VIII metal on a suitable support, such as a catalyst including cobalt and molybdenum on an alumina support. A number of compounds have previously been identified as reaction inhibitors for selective hydrodesulfurization catalysts. These reaction inhibitors reduce the activity of the catalyst for performing hydrodesulfurization.

U.S. Pat. No. 2,913,405 describes a process for desulfurizing a cracked feed to sulfur levels below 0.03 wt % sulfur. The process is described as providing better olefin retention for feeds that include a sufficiently large amount of nitrogen. Several examples are provided of adding a constant amount of nitrogen during a hydrodesulfurization process that is performed at a constant temperature.

U.S. Patent Application Publication No. 2003/0220186 describes a process for treating a catalyst to improve the selectivity of the catalyst for hydrodesulfurization relative to hydrogenation. The catalyst is first exposed to a protective agent, such as CO or ethanolamine. The exposure to the protective agent is maintained while the catalyst is also exposed to a concentration of olefinic species substantially greater than the amount of olefins present in any typical feed. After both the olefinic species and the protective agent are removed from the feed, the hydrodesulfurization activity of the catalyst will be mostly restored, while the hydrogenation activity will remain at a substantially lower level.

SUMMARY OF THE INVENTION

In an embodiment, a method for selectively hydrotreating a naphtha boiling range feed is provided. The method includes introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content. While continuing to introduce the naphtha boiling feed into the reactor under selective hydrodesulfurization conditions effective to maintain said product sulfur content in the hydrodesulfurized feed, the amount of inhibiting agent can be reduced and the weighted average bed temperature can be increased until the inhibiting agent is at least substantially removed from the reactor, the inhibiting agent being substantially removed from the reactor prior to the weighted average bed temperature being increased by about 8° F. (4° C.) relative to the weighted average bed temperature at the start of the reaction. Additionally or alternately, the product sulfur content can be maintained at a substantially constant amount of sulfur from about 5 ppm by weight to about 150 ppm by weight.

In another embodiment, a method for selectively hydrotreating a naphtha boiling range feed is provided. The method includes introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content. While continuing to introduce the naphtha boiling feed into the reactor under selective hydrodesulfurization conditions effective to maintain said product sulfur content in the hydrodesulfurized feed, the amount of inhibiting agent can be reduced until the inhibiting agent is at least substantially removed from the reactor. The product sulfur content can advantageously be maintained at a substantially constant amount of sulfur from about 5 ppm by weight to about 150 ppm by weight.

DETAILED DESCRIPTION OF THE EMBODIMENTS

Figure 1:
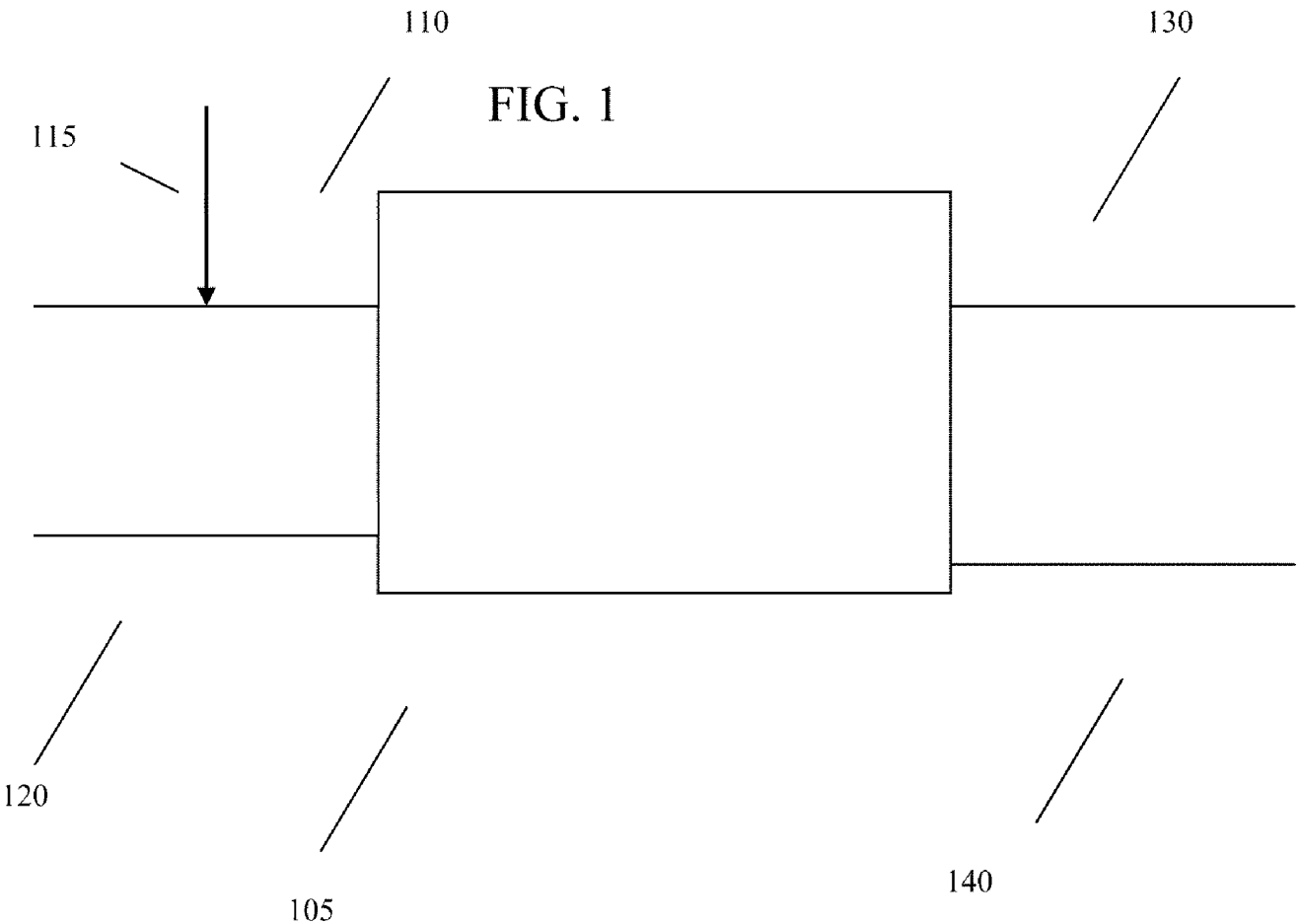
FIG. 1 schematically shows a reaction system for performing a process according to an embodiment of the invention.

In an embodiment, a process is provided for producing naphtha boiling range products with improved octane. Improved octane preservation can be achieved during the initial processing period after introducing a new hydrodesulfurization catalyst into a reactor. The improved octane preservation can be achieved by introducing a reaction inhibitor into the naphtha desulfurization reaction during the initial processing period. The amount of reaction inhibitor can be decreased over time during this initial processing period, in correspondence to the decrease in catalyst activity that occurs when a catalyst is exposed to a feed. In one preferred embodiment, the changes in inhibitor amount can be selected to maintain a constant amount of sulfur in the product of the selective hydrodesulfurization. In some embodiments, the amount of decrease in reaction inhibitor can be selected to offset the loss in catalyst activity, so that the initial processing period can be performed at a roughly constant reaction temperature. In other embodiments, the reaction inhibitor can be decreased as the reaction temperature is increased.

In a selective hydrodesulfurization process, a variety of considerations can be balanced in order to choose the processing temperature. It is often desirable to remove sulfur to a level that corresponds to the current requirements for low sulfur fuels. For example, production of a naphtha product with about 15 ppm by weight (wppm) or less, for example about 10 wppm or less, of sulfur is often desirable. Another consideration includes maintaining the activity of the catalyst. Typically, a catalyst tends to deactivate more quickly during higher temperature operation. Thus, lower operating temperatures can be preferred, particularly during the initial processing period after new catalyst has been added to a hydroprocessing reactor. Still another consideration includes preservation of olefins in the resulting naphtha product. Typically, processing a feed at a temperature that is higher than necessary to meet a desired sulfur specification can tend to result in additional saturation of olefins. This consideration would tend to suggest that lower reaction temperatures are preferable, to avoid overprocessing of a feed. However, the selectivity of a catalyst can also increase with increasing temperature. Here, selectivity refers to the relative activity for hydrodesulfurization versus activity for olefin saturation. Thus, there are factors that favor both lower and higher temperature processing.

Practical considerations can also play a role in selecting a process temperature. Typically, a reaction system for performing a hydrodesulfurization reaction is designed to operate within a pre-defined range of process conditions. These conditions can include ranges for temperatures, pressures, gas flow rates, and other factors. Operating a reaction system outside of the expected and/or desired operating ranges can lead to operational difficulties for the reaction system. As an example, in order to keep a reaction system within a desired operating range for temperature, the amount and type of catalyst can be selected so that the initial starting temperature is above the minimum desired temperature for the reaction system. However, when a selective hydrodesulfurization reactor is first started, the catalyst is freshly sulfided and likely has the highest possible activity. Thus, constraining the initial catalyst load to satisfy a minimum desired temperature requirement can lead to less catalyst being used and/or selecting a lower activity catalyst. Using less catalyst can tend to lead to a shorter catalyst lifetime at a constant rate of feed flow through a reactor. As a result, using less catalyst typically requires the hydrodesulfurization reactor to undergo more frequent maintenance and therefore increased down time. Using a less active catalyst also tends to require higher temperature operation over the life of a catalyst, which also tends to reduce catalyst lifetime.

While all of the above considerations can be balanced to select a temperature for performing a selective hydrodesulfurization, it would be beneficial if the temperature requirements for the start of a selective hydrodesulfurization process could be decoupled from the requirements at the end of a run. In various embodiments, the start of run and end of run temperatures can be decoupled by addition of a reaction inhibitor at the start of the run. Using a reaction inhibitor can advantageously raise the temperature at the start of the run, and/or can allow a larger amount of catalyst to be used. As the catalyst deactivates, the amount of reaction inhibitor can be reduced. By balancing the catalyst deactivation against the reduction in reaction inhibitor, a stable temperature can be used at the start of the run. Additionally or alternately, the temperature can also be adjusted during this start of run period. Preferably, the reduction in the amount of reaction inhibitor can continue until the reaction inhibitor is removed from the reactor. At that point the reactor can be operated according to the typical methods for performing a selective hydrodesulfurization.

In some embodiments, the use of a reaction inhibitor can allow a higher start of run temperature to be selected, perhaps leading to improved olefin preservation. In other embodiments, the amount of catalyst in a reactor can be increased, perhaps providing an improved run length. In still other embodiments, a combination of these benefits can be achieved.

Feedstocks

In various embodiments, the feedstock for a selective hydrodesulfurization process can be an olefinic naphtha boiling range feed. Suitable feedstocks typically boil in the range from about 50° F. (about 10° C.) to about 450° F. (about 232° C.). With regard to olefin content, suitable feedstocks can include feedstocks having an olefin content of at least about 5 wt %. Non-limiting examples of suitable feedstocks can include, but are not limited to, fluid catalytic cracking unit naphtha (FCC naphtha or cat naphtha), steam cracked naphtha, coker naphtha, virgin naphtha, or a combination thereof. Also suitable are blends of olefinic naphthas with non-olefinic naphthas, as long as the blend has an olefin content of at least about 5 wt %.

Olefinic naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstock can contain an overall olefins concentration of about 60 wt % or less, for example about 50 wt % or less or about 40 wt % or less. Additionally or alternately in such feedstock, the olefin concentration can be at least about 5 wt %, for example at least about 10 wt % or at least about 20 wt %. Further additionally or alternately, the olefinic naphtha feedstock can also have a diene concentration up to about 15 wt %, but more typically less than about 5 wt %, based on the total weight of the feedstock. High diene concentrations are generally undesirable, as they can result in a gasoline product having poor stability and color.

The sulfur content of the olefinic naphtha can be at least about 100 wppm, for example at least about 500 wppm, at least about 1000 wppm, or at least about 1500 wppm. Additionally or alternately in such olefinic naphtha, the sulfur content can be about 7000 wppm or less, for example about 6000 wppm or less, about 5000 wppm or less, or about 3000 wppm or less. The sulfur can typically be present as organically bound sulfur, i.e., as sulfur compounds such as simple aliphatic, naphthenic, and aromatic mercaptans, sulfides, di- and polysulfides and the like. Other organically bound sulfur compounds can include heterocyclic sulfur compounds such as thiophene and its higher homologs and analogs.

Nitrogen can also be present in the feed. Independent of the sulfur content of the feedstock in certain embodiments, the amount of nitrogen can be at least about 5 wppm, for example at least about 10 wppm, at least about 20 wppm, or at least about 40 wppm. Additionally or alternately in such feedstock, the nitrogen content can be about 250 wppm or less, for example about 150 wppm or less, about 100 wppm or less, or about 50 wppm or less.

Selective Hydrodesulfurization Catalyst

In various embodiments, suitable selective hydrodesulfurization catalysts include catalysts that are comprised of metals containing at least one Group VIII metal (e.g., in oxide form or in a sulfided version of oxide form), e.g., selected from Co and/or Ni, preferably containing at least Co, and at least one Group VIB metal (e.g., in oxide form or in a sulfided version of oxide form), e.g., selected from Mo and/or W, preferably containing at least Mo, optionally but preferably on a support material, such as silica and/or alumina. Other suitable hydrotreating catalysts can include, but may not be strictly limited to, zeolitic catalysts, as well as noble metal catalysts, e.g., where the noble metal is selected from Pd and/or Pt. It is within the scope of the present invention that more than one type of hydrotreating catalyst be used in the same reaction vessel. The Group VIII metal of a selective hydrodesulfurization catalyst can be present in an amount ranging from about 0.1 wt % to about 20 wt %, for example from about 1 wt % to about 12 wt %. The Group VIB metal can be present in an amount ranging from about 1 wt % to about 50 wt %, for example from about 2 wt % to about 20 wt %. All weight percents of metals are given in oxide form on support. By "on support" is meant that the percents are based on the weight of the support. For example, if the support were to weigh 100 grams, then 20 wt % Group VIII metal would mean that 20 grams of Group VIII metal oxide is on the support.

The selective hydrodesulfurization catalysts used in the practice of the present invention are preferably supported catalysts. Any suitable refractory catalyst support material, preferably metallic oxide support materials, can be used as supports for the catalyst. Non-limiting examples of suitable support materials can include: zeolites, alumina, silica, titania, calcium oxide, strontium oxide, barium oxide, thermally (at least partially) decomposed organic media, zirconia, magnesia, diatomaceous earth, lanthanide oxides (including cerium oxide, lanthanum oxide, neodymium oxide, yttrium oxide, and praseodymium oxide), chromia, thorium oxide, urania, niobia, tantala, tin oxide, zinc oxide, corresponding phosphates, and the like, and combinations thereof. Preferred supports can include alumina, silica, and silica-alumina. It is to be understood that the support material can also contain small amounts of contaminants, such as Fe, sulfates, and various metal oxides, that can be introduced during the preparation of the support material. These contaminants are typically present in the raw materials used to prepare the support and can preferably be present in amounts less than about 1 wt %, based on the total weight of the support. It is preferred that the support material be substantially free of such contaminants. In another embodiment, about 0 wt % to about 5 wt %, for example from about 0.5 wt % to about 4 wt % or from about 1 wt % to about 3 wt % of an additive can be present in the support, which additive can be selected from the group consisting of phosphorus and metals or metal oxides from Group IA (alkali metals) of the Periodic Table of the Elements.

Reaction Inhibitors

In various embodiments, one or more reaction inhibitors can be used to control the activity of the selective hydrodesulfurization catalyst. Suitable reaction inhibitors are substances that suppress catalyst activity for hydrogenation of olefins to a degree that is substantially similar to, or greater than, the degree to which catalyst activity for hydrodesulfurization is suppressed. In other words, after introduction of a suitable reaction inhibitor, the catalyst can typically show a selectivity for performing hydrodesulfurization rather than olefin saturation that is greater than, or roughly equal to, the selectivity prior to introduction of the inhibitor.

Suitable reaction inhibitors can include, but are not limited to, organic compounds containing a basic nitrogen group. Amines such as aniline or heterocyclic compounds such as pyridine are non-limiting examples of reaction inhibitors.

In embodiments where one of the goals of the reaction inhibitor is to selectively suppress olefin saturation, some contaminants known to suppress catalyst activity may not be suitable for use as reaction inhibitors. For example, carbon monoxide is a known suppressant for catalyst activity. However, it is believed that carbon monoxide more strongly suppresses the hydrodesulfurization activity of a catalyst, as compared to olefin saturation activity. As a result, it is believed that carbon monoxide is not a suitable reaction inhibitor, as addition of carbon monoxide to a reaction system could lead to increased olefin saturation at a constant level of sulfur removal.

The amount of reaction inhibitor to add can be dependent on any one or more of a variety of factors. With regard to the initial amount of reaction inhibitor, the amount can be selected in conjunction with decisions on the type of catalyst to use, how much catalyst to use, the desired start of run temperature, the nature of the feed, and the desired product sulfur level, inter alia. In an embodiment, the amount of reaction inhibitor can be an amount corresponding to at least about 10 wppm of nitrogen, for example at least about 20 wppm of nitrogen, at least about 50 wppm of nitrogen, or at least about 100 wppm of nitrogen. Additionally or alternately, the amount of reaction inhibitor can be an amount corresponding to about 250 wppm of nitrogen or less, for example about 200 wppm of nitrogen or less, about 150 wppm of nitrogen or less, or about 100 wppm of nitrogen or less.

In still other embodiments, the amount of reaction inhibitor can be measured in terms of the amount of inhibitor, as opposed to the corresponding amount of nitrogen. In such embodiments, the amount of reaction inhibitor can be at least about 0.1 wppm, for example at least about 1 wppm, at least about 10 wppm, at least about 50 wppm, or at least about 100 wppm. Additionally or alternately, the amount of reaction inhibitor can be about 10000 wppm or less, for example about 1000 wppm or less, about 500 wppm or less, or about 100 wppm or less.

Note that some nitrogen compounds that can be present in a feed may act as reaction inhibitors. In embodiments where nitrogen compounds are present in the feed, additions of a reaction inhibitor are understood to be in addition to the reaction-inhibiting nitrogen present in the feed. Similarly, reducing the amount of reaction inhibitor refers to reducing the amount of added reaction inhibitor. This is in contrast to removal of nitrogen during the hydrodesulfurization process. While a typical hydrodesulfurization process will typically also remove nitrogen, such removal via hydrodesulfurization means that, by definition, the feed has come into contact with the catalyst. As a result, removal of nitrogen by hydrodesulfurization does not prevent reaction inhibition in the stage where removal takes place.

Reaction Conditions and Environment

The selective hydrodesulfurization can be performed in any suitable reaction system. The selective hydrodesulfurization can be performed in one or more fixed bed reactors, each of which can comprise one or more catalyst beds of the same, or different, hydrodesulfurization catalyst. Optionally, more than one type of catalyst can be used in a single bed. Although other types of catalyst beds can be used, fixed beds are preferred in some embodiments. Non-limiting examples of such other types of catalyst beds that may be used in the practice of the present invention include, but are not limited to, fluidized beds, ebullating beds, slurry beds, and moving beds. Interstage cooling between reactors, or between catalyst beds in the same reactor, can be employed since some olefin saturation can take place, and olefin saturation as well as the desulfurization reaction are generally exothermic. A portion of the heat generated during hydrodesulfurization can be recovered by conventional techniques. Where this heat recovery option is not available, conventional cooling may be performed, e.g., through cooling utilities such as cooling water or air, or by use of a hydrogen quench stream. In this manner, optimum reaction temperatures can be more easily maintained.

The reaction inhibitor can be introduced into the reaction in any convenient manner. In an embodiment, a separate feed line or injection port can be available for introducing the reaction inhibitor into the reactor. Alternately, in the embodiment shown in FIG. 1, naphtha feed 110 and reaction inhibitor 115 can be introduced into the reaction system 105 using a single feed line. Another input line 120 can be used for the hydrogen treat gas. In FIG. 1, the inhibitor can be added to the naphtha feed prior to entry of the feed into the reactor 105. The resulting hydrodesulfurized naphtha can be removed from the reaction system as a liquid product 130, while an off-gas 140 can be removed from the reaction system via a separate line. Note that reaction system 105 is schematically shown here, and can include several components, such as a reactor, a product quench stage, and/or a separator.

Generally, selective hydrodesulfurization conditions can include temperatures from about 425° F. (about 218° C.) to about 800° F. (about 427° C.), for example from about 500° F. (about 260° C.) to about 675° F. (about 357° C.). In an embodiment, the temperature at the start of a reaction run can be at least about 450° F. (about 232° C.), for example at least about 475° F. (about 246° C.), at least about 500° F. (about 260° C.), or at least about 510° F. (about 266° C.). Additionally or alternately, the temperature at the start of a run can be about 575° F. (about 302° C.) or less, for example about 540° F. (about 282° C.) or less or about 525° F. (about 274° C.) or less.

In another embodiment, optionally in combination with those in the previous paragraph, the temperature at the end of a processing run can be about 800° F. (about 427° C.) or less, for example about 750° F. (about 399° C.) or less, about 700° F. (about 371° C.) or less, about 675° F. (about 357° C.) or less, or about 650° F. (about 343° C.) or less. Additionally or alternately, the temperature at the end of a processing run can be at least about 550° F. (about 288° C.), for example at least about 575° F. (about 302° C.), at least about 600° F. (about 316° C.), or at least about 625° F. (about 329° C.).

In various embodiments, the temperature selected as the end of a processing run can be dependent on any one or more of a variety of factors. For example, it could be desirable to operate the reactor and other equipment in a reaction system at temperatures below a certain value. This could be due to equipment limitations, a desired temperature in another upstream or downstream process, or for other reasons. Another consideration can include the rate of catalyst deactivation. As a catalyst deactivates, the number of remaining active sites on catalyst can be reduced. When many of the active sites on a catalyst are deactivated, the process stability for using the catalyst can be reduced. This could be reflected, for example, in the need to increase temperature at a faster rate in order to maintain a substantially constant sulfur level. Additionally, as noted above, some types of catalysts generally deactivate more quickly at higher temperatures.

In an embodiment, the temperature differential between the beginning of a hydrodesulfurization process and the end of the process can be at least about 25° F. (about 14° C.), for example at least about 50° F. (about 28° C.), at least about 75° F. (about 42° C.), or at least about 100° F. (about 56° C.). Additionally or alternately, the temperature differential between the start of a run and the end of a run can be about 300° F. (about 167° C.) or less, for example about 200° F. (about 111° C.) or less, about 150° F. (about 83° C.) or less, about 100° F. (about 56° C.) or less, or about 75° F. (about 42° C.) or less.

Other selective hydrodesulfurization conditions can include a pressure from about 60 psig (about 410 kPag) to about 800 psig (about 5.5 MPag), for example from about 200 psig (about 1.4 MPag) to about 500 psig (about 3.4 MPag) or from about 250 psig (about 1.7 MPag) to about 400 psig (about 2.8 MPag). The hydrogen feed rate can be from about 500 standard cubic feet per barrel (scf/b) (about 84 $Nm^3/m^3$) to about 6000 scf/b (about 1000 $Nm^3/m^3$), for example from about 1000 scf/b (about 170 $Nm^3/m^3$) to about 3000 scf/b (about 510 $Nm^3/m^3$). The liquid hourly space velocity can be from about 0.5 $hr^{-1}$ to about 15 $hr^{-1}$, for example from about 0.5 $hr^{-1}$ to about 10 $hr^{-1}$ or from about 1 $hr^{-1}$ to about 5 $hr^{-1}$.

Product Characterization and Control of Reaction Conditions

In various embodiments, a hydrotreated naphtha can be produced with reduced loss of octane as compared to a hydrotreated naphtha formed from a (conventional) process that does not employ a reaction inhibitor. Because the same catalyst can be used at a higher reaction temperature, olefin saturation can be reduced. This can lead to higher values for the road octane number (RON) and/or the motor octane number (MON) for the resulting hydrotreated naphtha.

In various embodiments, one possible goal of a selective hydrodesulfurization process can be to produce a naphtha product having a substantially constant level of sulfur. In an embodiment, the substantially constant level of sulfur can be at least about 5 wppm, for example at least about 10 wppm or at least about 20 wppm. Additionally or alternately, the substantially constant level of sulfur can be about 150 wppm or less, for example about 100 wppm or less, about 75 wppm or less, about 50 wppm or less, about 30 wppm or less, about 15 wppm or less, or about 10 wppm or less. As used herein, maintaining a substantially constant level of sulfur in the hydrodesulfurized product is defined as maintaining the sulfur level to within about 5 wppm of the target level. Nevertheless, while sulfur levels can temporarily spike or plummet due to various circumstances, maintaining a substantially constant level of sulfur in the hydrodesulfurized product can still include instances where the sulfur level is, at one given point in time, more than about 5 wppm from the target level, so long as the sulfur level is within about 5 wppm of the target level for at least 95% (i.e., at least 19 out of every 20 sampling events over the course) of a hydrodesulfurization run and so long as the average sulfur level of the hydrodesulfurization run is within about 5 wppm of the target level.

It can be desirable to maintain a substantially constant level of sulfur in the naphtha product for a variety of reasons. Maintaining a constant level of sulfur can allow for process control, as a gasoline formulator will be able to rely on the specifications for the naphtha product. For this purpose, maintaining a substantially constant sulfur level can be beneficial, because the sulfur content does not increase. It can also be desirable to provide a substantially constant sulfur level to prevent the sulfur level from being too low. At the product sulfur levels described for embodiments of this invention, removing additional sulfur can sometimes indicate that the reaction conditions may be too severe. Using more severe hydrodesulfurization conditions can often result in increased saturation of olefin bonds. Thus, achieving a sulfur level that is lower than the target level can actually be detrimental in some instances, as the processing used to achieve the lower sulfur level may also further reduce the RON and/or MON of the naphtha product.

One way to maintain a desired sulfur level can be to use the product sulfur level to provide feedback for the process conditions. Various methods are available for detecting product sulfur levels. One option for monitoring sulfur levels can be to withdraw samples of the hydrodesulfurized naphtha and analyze the sample for sulfur. Due to the time scales involved in catalyst deactivation during processing, off-line analysis of a naphtha sample can be sufficient to allow for maintaining a substantially constant level. Alternatively, techniques for in-line monitoring of sulfur content levels in a hydrodesulfurized naphtha product are also available.

Feedback based on the sulfur level in the naphtha product can be used to adjust reaction conditions so that a substantially constant level of product sulfur is maintained. In various embodiments, adjusting the reaction conditions can include adjusting the temperature of the catalyst bed (the Weighted Average Bed Temperature), reducing the amount of reaction inhibitor, or a combination thereof. Because the reaction inhibitor is an added component in the reactor, one option can be to initially control the product sulfur level by maintaining a constant temperature while reducing the amount of inhibitor. This can lead to removing the reaction inhibitor in a relatively short (potentially an optimized) amount of time without having to increase the temperature.

Other options for controlling the sulfur level can include using a combination of temperature adjustments and reductions in the amount of inhibitor. For example, the amount of inhibitor can be smoothly increased while the temperature is smoothly decreased, so that the inhibitor can be removed from the system by the time a target temperature is reached. Preferably, the inhibitor can be removed from the reaction system prior to the reaction temperature increasing by 6° F. (3° C.) relative to the start of run temperature, for example prior to the reaction temperature increasing by 8° F. (4° C.) or prior to the reaction temperature increasing by 10° F. (6° C.).

In yet another embodiment, the inhibitor can be removed in discreet steps. This can cause the temperature to be adjusted both up and down during the initial period of the reaction, as some temperature increases may be needed to adjust for catalyst activity loss while other decreases may be needed to adjust for the increase in catalyst activity when a "step" of inhibitor is removed.

In still another embodiment, the inhibitor can continue to be present in the reactor for some or all of the reaction run length. If sufficiently low levels of inhibitor are present, the inhibitor can have merely a nominal impact on catalyst activity. As a result, in some embodiments it can be sufficient to substantially remove the inhibitor from the reactor. In various embodiments, the inhibitor can be considered to be substantially removed when the amount of inhibitor added to the reaction environment due to the inhibitor is about 20 wppm or less. Alternately, the inhibitor can be reduced to a level of about 10 wppm or less, or about 5 wppm or less. In still another embodiment, the amount of inhibitor corresponding to substantial removal of the inhibitor can be an amount based on the peak level of inhibitor used. For example, substantial removal of the inhibitor can correspond to reducing the amount of inhibitor to about 10% or less of the largest amount (peak level) of inhibitor, or reducing the amount to about 5% or less of the peak amount. Note that for an embodiment where the inhibitor comprises a nitrogen containing compound, the amount of inhibitor can advantageously refer to the amount of nitrogen. Also note that for any inhibitor that is present in the naphtha feed prior to addition of the inhibitor, reducing the amount of inhibitor is judged based on the amount of inhibitor added to the feed, and not based on the amount of added inhibitor plus the amount originally present in the feed.

Preferably, the combination of temperature modification and inhibitor reduction to maintain a substantially constant sulfur level in the naphtha product can be selected so that any temperature decrease relative to the start of run reaction temperature is less than about 6° F. (3° C.), for example less than about 8° F. (4° C.) or less than about 10° F. (6° C.). Additionally or alternately, the combination of temperature modification and inhibitor reduction to maintain a substantially constant sulfur level in the naphtha product can be selected so that the temperature decrease relative to any temperature achieved during a reaction process is less than about 6° F. (3° C.), for example less than about 8° F. (4° C.) or less than about 10° F. (6° C.). In various embodiments, one of the benefits of the invention can be to avoid loss of octane in the hydrodesulfurized naphtha product. If a large portion of the inhibitor is removed at one time, a corresponding large decrease in temperature may be required, which can lead to an increase in olefin saturation. The combinations of temperature modification and inhibitor reduction according to embodiments of the invention preferably avoid such large temperature decreases, so as to provide improved octane retention.

Figure 2:
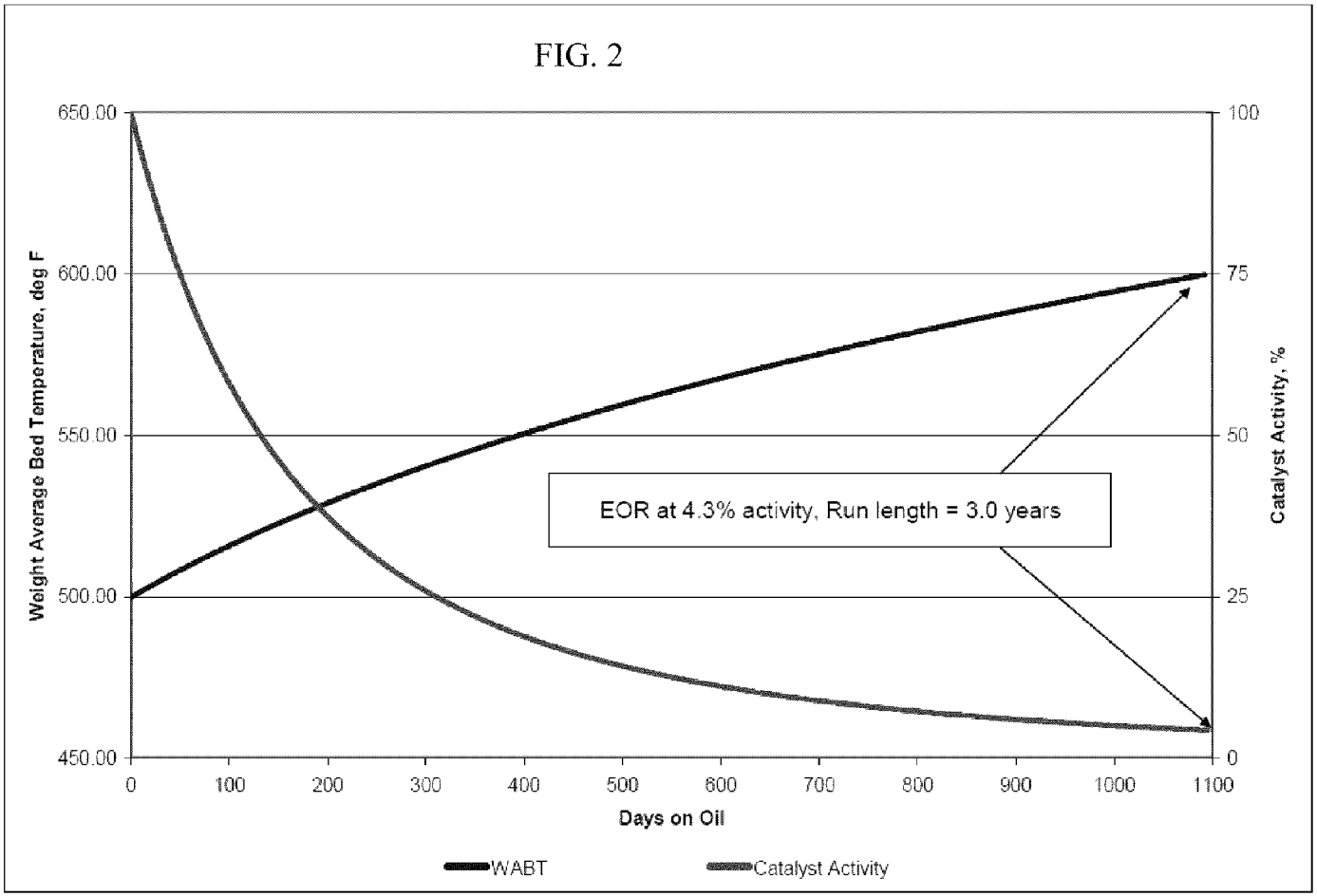
FIG. 2 shows predicted results from a comparative example of a selective hydrodesulfurization process.
Figure 3:
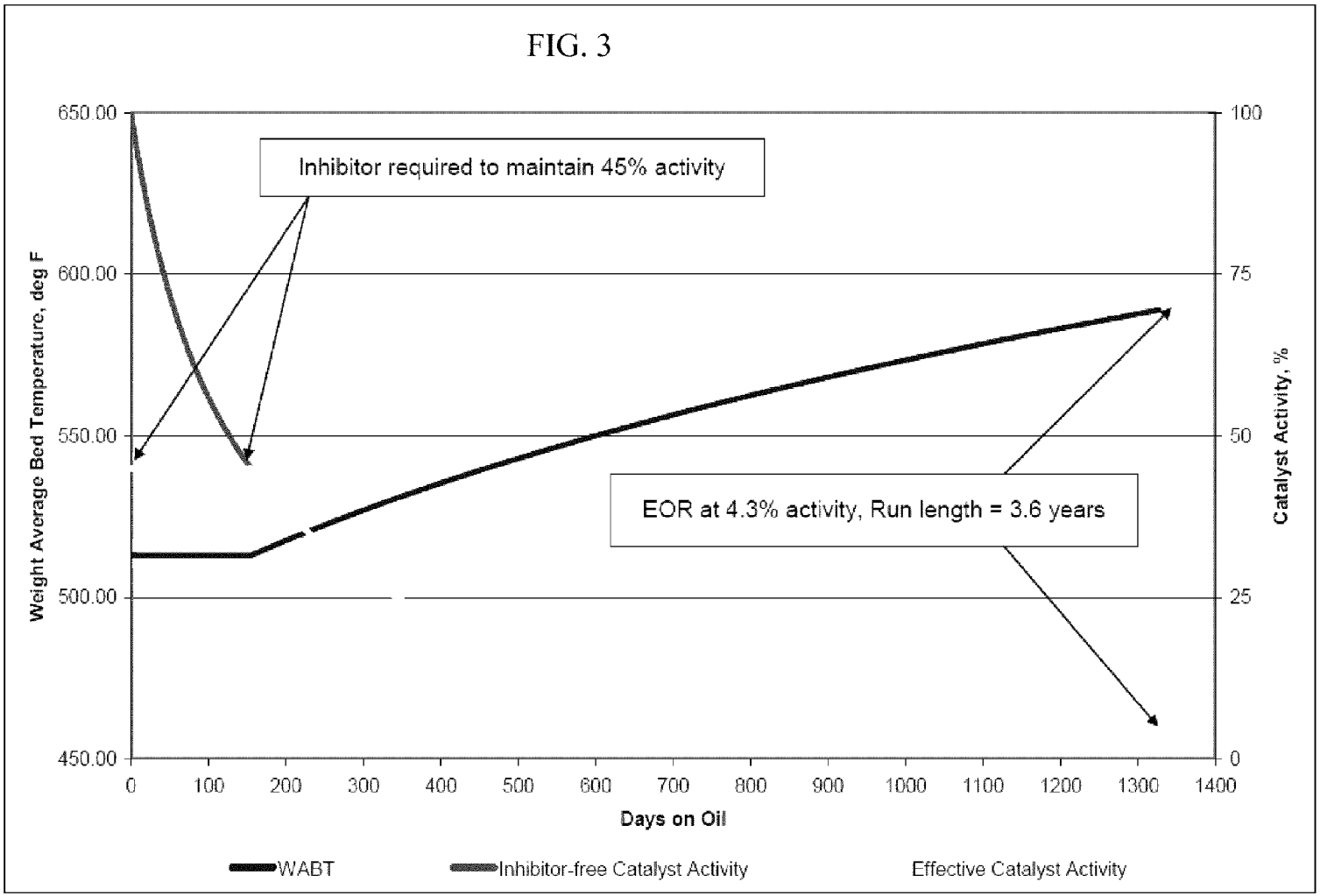
FIG. 3 shows predicted results from an example of a selective hydrodesulfurization process according to an embodiment of the invention.

FIGS. 2 and 3 show predicted results from a kinetic model based on pilot plant runs for naphtha hydrodesulfurization. The kinetic model was used to model a reaction involving an FCC naphtha containing about 1000 wppm of sulfur with a bromine number of about 50. In the model examples shown in FIGS. 2 and 3, a demonstration is provided of how an embodiment of the claimed invention can be used to both increase the reaction temperature at the start of run (thus improving octane) and also allow for increased amounts of catalyst in the bed (thus improving catalyst lifetime at a given feed rate).

FIG. 2 shows results from the model for a conventional hydrodesulfurization run where no reaction inhibitor was added. Under the conditions set in the model, the hydrodesulfurization reactor was started at a Weighted Average Bed Temperature (WABT) of about 500° F. The feeds to the reaction were about 20,000 Barrels/Day (about 3200 $m^3$/day) of the naphtha feed described above and a treat gas feed with a treat gas ratio of about 2000 scf/b (about 340 $Nm^3/m^3$) of about 80% hydrogen. A catalyst volume of about 5900 $ft^3$ (about 170 $m^3$) of a naphtha hydrodesulfurization catalyst was used. In this run without the reaction inhibitor, the relative volume activity of the catalyst is defined to be 100%. Under these reaction conditions, the model resulted in catalyst deactivation rate of about 2.8° F. (about 1.5° C.) per month.

Based on the above conditions, the ~1000 wppm of sulfur in the feed was reduced to about 18 wppm in the selectively hydrodesulfurized naphtha product. As the run progressed, the catalyst deactivated with time, leading to increases in temperature to compensate for the loss in catalyst activity. The predicted road octane number (RON) loss under these conditions was about 5.6, while the predicted motor octane number (MON) loss was about 2.9. These octane loss numbers were based on the predicted loss of olefins in the model under the specific reaction conditions.

With regard to catalyst lifetime, the catalyst activity at the start of the run can be considered to be 100%. After about 3 years of service, the temperature required to maintain the desired product sulfur level of about 18 wppm has increased by about 100° F. (about 56° C.) to about 600° F. (about 316° C.). In the modeled embodiment, a temperature of 600° F. (316° C.) was considered the desired end of run temperature. This corresponds to the catalyst having a relative volume activity of about 4%. FIG. 2 shows the full temperature profile and catalyst activity profile for the model reaction.

FIG. 3 shows processing of the same feed, but with an inhibitor introduced as part of the conditions. In the model reaction shown in FIG. 3, the amount of catalyst in the bed was increased to about 8000 $ft^3$ (about 230 $m^3$). A catalyst with the same initial relative volume activity was used. For this amount of catalyst, a start of run temperature of about 480° F. (about 249° C.) was sufficient to achieve a product sulfur level of about 18 wppm. However, sufficient inhibitor was added to the reaction to cause the effective relative volume activity for the catalyst at the start of the run to be about 45% instead of 100%. The feed rate and treat gas ratio were the same as for FIG. 2. Under these conditions and with the addition of the reaction inhibitor, an initial WABT of about 513° F. (about 267° C.) was needed to achieve the same product naphtha sulfur level of about 18 wppm.

When the processing run was started, the temperature was initially held constant at about 513° F. (about 267° C.). Instead of increasing the temperature to compensate for loss in catalyst activity, the amount of added inhibitor was reduced to maintain the desired naphtha product sulfur of about 18 wppm. This continued until about day 155 of the processing run, when the catalyst activity reached about 45% relative volume activity without any addition of inhibitor. At that point, temperature increases were used to compensate for further losses in catalyst activity. In order to facilitate comparison with the results from FIG. 2, an end of run condition was selected that corresponded to a ~100° F. (~56° C.) differential relative to the about 480° F. (about 249° C.) start of run temperature that would have been used without the inhibitor. This "~100° F. differential" was selected for the FIG. 3 run so that the end of run condition in both runs corresponded to a comparable level of catalyst deactivation.

Under these conditions, the loss in RON was about 5.1, as compared to the about 5.6 for the reaction in FIG. 2 with no inhibitor. Similarly, the loss in MON was reduced to about 2.7 as opposed to the about 2.9 for the run shown in FIG. 2. Additionally, due in part to the increase in the amount of catalyst used, the lifetime of the catalyst was increased to about 3.6 years, based on the time required to reach the end of run temperature differential of ~100° F. (~56° C.). Thus, the reaction shown in FIG. 3 provided for greater octane retention in hydrodesulfurized naphtha while also enabling a longer run length for a reactor.

Additional Embodiments

Additionally or alternately, the present invention includes the following embodiments.

Embodiment 1

A method for selectively hydrotreating a naphtha boiling range feed, comprising: introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content; and reducing the amount of inhibiting agent and increasing the weighted average bed temperature, while continuing to introduce the naphtha boiling feed into the reactor under selective hydrodesulfurization conditions effective to maintain said product sulfur content in the hydrodesulfurized feed, until the inhibiting agent is at least substantially removed from the reactor, the inhibiting agent being substantially removed from the reactor prior to the weighted average bed temperature being increased by about 8° F. (4° C.) relative to the weighted average bed temperature at the start of the reaction, wherein said product sulfur content is maintained at a substantially constant amount of sulfur from about 5 ppm by weight to about 150 ppm by weight.

Embodiment 2

A method for selectively hydrotreating a naphtha boiling range feed, comprising: introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content; and reducing the amount of inhibiting agent, while continuing to introduce the naphtha boiling feed into the reactor under selective hydrodesulfurization conditions effective to maintain said product sulfur content in the hydrodesulfurized feed, until the inhibiting agent is at least substantially removed from the reactor, wherein said product sulfur content is maintained at a substantially constant amount of sulfur from about 5 ppm by weight to about 150 ppm by weight.

Embodiment 3

The method of embodiment 1, wherein, after starting the reduction in the amount of inhibiting agent, the weighted average bed temperature is not decreased.

Embodiment 4

The method of embodiment 1, wherein, after starting the reduction in the amount of inhibiting agent, the weighted average bed temperature is decreased by about 8° F. (4° C.) or less relative to the temperature (i) at the start of the hydrotreating, (ii) achieved during the hydrotreating, or (iii) both (i) and (ii).

Embodiment 5

The method of any of the previous embodiments, further comprising monitoring the product sulfur content in the hydrodesulfurized feed, wherein the reduction of the amount of inhibiting agent, the increase in weighted average bed temperature, or both are responsive to the monitored product sulfur content.

Embodiment 6

The method of any of the previous embodiments, wherein the inhibiting agent is substantially removed prior to the temperature increasing by about 6° F. (3° C.) relative to the temperature at the start of the hydrotreating.

Embodiment 7

The method of any of the previous embodiments, wherein the substantially constant amount of sulfur is less than about 75 wppm, for example from about 10 wppm to about 30 wppm.

Embodiment 8

The method of any of the previous embodiments, wherein the inhibiting agent is reduced to a level of about 10 wppm or less in the reactor or is removed from the reactor entirely.

Embodiment 9

The method of any of the previous embodiments, wherein the inhibiting agent is reduced to a level of about 5% or less of a peak level of inhibitor in the reactor.

Embodiment 10

The method of any of the previous embodiments, wherein (i) the weighted average bed temperature at the start of the hydrotreating is from about 450° F. (about 232° C.) to about 575° F. (about 302° C.), (ii) the weighted average bed temperature at an end of the hydrotreating is from about 550° F. (about 288° C.) to about 750° F. (about 399° C.), or (iii) both (i) and (ii).

Embodiment 11

The method of any of the previous embodiments, wherein the weighted average bed temperature at an end of the hydrotreating corresponds to a differential between a start of run temperature and an end of run temperature of from about 75° F. (about 42° C.) to about 250° F. (about 139° C.), or alternately of about 150° F. (about 83° C.) or less.

Embodiment 12

The method of any of the previous embodiments, wherein the effective selective hydrodesulfurization conditions include a pressure of from about 60 psig (about 410 kPag) to about 800 psig (about 5.5 MPag), for example from about 200 psig (about 1.4 MPag) to about 500 psig (about 3.4 MPag), a hydrogen feed rate from about 500 scf/b (about 84 $Nm^3/m^3$) to about 6000 scf/b (about 1000 $Nm^3/m^3$), for example from about 1000 scf/b (about 170 $Nm^3/m^3$) to about 3000 scf/b (about 500 $Nm^3/m^3$), and a liquid hourly space velocity from about 0.5 $hr^{-1}$ to about 15 $hr^{-1}$, for example from about 0.5 $hr^{-1}$ to about 10 $hr^{-1}$.

While the present invention has been described and illustrated by reference to particular embodiments, those of ordinary skill in the art will appreciate that the invention lends itself to variations not necessarily explicitly illustrated herein. For this reason, then, reference should be made solely to the appended claims for purposes of determining the true scope of the present invention.

What is claimed is:

1. A method for selectively hydrotreating a naphtha boiling range feed, comprising:

introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content; and reducing the amount of inhibiting agent and increasing the weighted average bed temperature, while continuing to introduce the naphtha boiling feed into the reactor under selective hydrodesulfurization conditions effective to maintain said product sulfur content in the hydrodesulfurized feed, until the inhibiting agent is at least substantially removed from the reactor, the inhibiting agent being substantially removed from the reactor prior to the weighted average bed temperature being increased by about 8° F. (4° C.) relative to the weighted average bed temperature at the start of the reaction, wherein said product sulfur content is maintained at a substantially constant amount of sulfur from about 5 ppm by weight to about 150 ppm by weight.

2. The method of claim 1, wherein, after starting the reduction in the amount of inhibiting agent, the weighted average bed temperature is not decreased.

3. The method of claim 1, wherein, after starting the reduction in the amount of inhibiting agent, the weighted average bed temperature is decreased by about 8° F. (4° C.) or less relative to the temperature at the start of the hydrotreating.

4. The method of claim 1, wherein, after starting the reduction in the amount of inhibiting agent, the weighted average bed temperature is decreased by about 8° F. (4° C.) or less relative to a temperature achieved during the hydrotreating.

5. The method of claim 1, further comprising monitoring the product sulfur content in the hydrodesulfurized feed, wherein the reduction of the amount of inhibiting agent and the increase in weighted average bed temperature are responsive to the monitored product sulfur content.

6. The method of claim 1, wherein the inhibiting agent is substantially removed prior to the temperature increasing by about 6° F. (3° C.) relative to the temperature at the start of the hydrotreating.

7. The method of claim 1, wherein the substantially constant amount of sulfur is less than about 75 wppm.

8. The method of claim 1, wherein the substantially constant amount of sulfur is from about 10 wppm to about 30 wppm.

9. The method of claim 1, wherein the inhibiting agent is reduced to a level of about 10 wppm or less in the reactor.

10. The method of claim 1, wherein the inhibiting agent is removed from the reactor.

11. A method for selectively hydrotreating a naphtha boiling range feed, comprising:

introducing a naphtha boiling range feed into a reactor in the presence of a hydrodesulfurization catalyst and an effective amount of inhibiting agent under effective selective hydrodesulfurization conditions, the selective hydrodesulfurization conditions including a weighted average bed temperature for the catalyst, to produce a hydrodesulfurized feed having a product sulfur content; and reducing the amount of inhibiting agent, while continuing to introduce the naphtha boiling feed into the reactor under selective hydrodesulfurization conditions effective to maintain said product sulfur content in the hydrodesulfurized feed, until the inhibiting agent is at least substantially removed from the reactor, wherein said product sulfur content is maintained at a substantially constant amount of sulfur from about 5 ppm by weight to about 150 ppm by weight.

12. The method of claim 11, further comprising monitoring the product sulfur content in the hydrodesulfurized feed, wherein the reduction of the amount of inhibiting agent is responsive to the monitored product sulfur content.

13. The method of claim 11, wherein the inhibiting agent is reduced to a level of about 10 wppm or less in the reactor.

14. The method of claim 11, wherein the inhibiting agent is reduced to a level of about 5% or less of a peak level of inhibitor in the reactor.

15. The method of claim 11, wherein the weighted average bed temperature at the start of the hydrotreating is from about 450° F. (about 232° C.) to about 575° F. (about 302° C.).

16. The method of claim 11, wherein the weighted average bed temperature at an end of the hydrotreating is from about 550° F. (about 288° C.) to about 750° F. (about 399° C.).

17. The method of claim 11, wherein the weighted average bed temperature at an end of the hydrotreating corresponds to a differential between a start of run temperature and an end of run temperature of from about 75° F. (about 42° C.) to about 250° F. (about 139° C.).

18. The method of claim 11, wherein the weighted average bed temperature at an end of the hydrotreating corresponds to a differential between a start of run temperature and an end of run temperature of about 150° F. (about 83° C.) or less.

19. The method of claim 11, wherein the effective selective hydrodesulfurization conditions include a pressure of from about 60 psig (about 410 kPag) to about 800 psig (about 5.5 MPag), a hydrogen feed rate from about 500 scf/b (about $8^4 Nm^3/m^3$) to about 6000 scf/b (about 1000 $Nm^3/m^3$), and a liquid hourly space velocity from about 0.5 $hr^{-1}$ to about 15 $hr^{-1}$.

20. The method of claim 11, wherein the effective selective hydrodesulfurization conditions include a pressure from about 200 psig (about 1.4 MPag) to about 500 psig (about 3.4 MPag), a hydrogen feed rate from about 1000 scf/b (about 170 $Nm^3/m^3$) to about 3000 scf/b (about 500 $Nm^3/m^3$), and a liquid hourly space velocity from about 0.5 $hr^{-1}$ to about 10 $hr^{-1}$.

* * * * *